United States Patent [19]

Fasano

[11] Patent Number: 4,909,305

[45] Date of Patent: Mar. 20, 1990

[54] METHOD TO OBTAIN THIN SLABS AND CRYSTALLIZER WHICH EMPLOYS SUCH METHOD

[75] Inventor: Fulvio Fasano, Gorizia, Italy

[73] Assignee: Danieli and C. Officine Meccaniche SpA, Buttrio, Italy

[21] Appl. No.: 180,838

[22] Filed: Apr. 12, 1988

[30] Foreign Application Priority Data

Apr. 27, 1987 [IT] Italy ..... 83361 A/87

[51] Int. Cl.[4] ..... B22D 11/00

[52] U.S. Cl. ..... 164/459; 164/418

[58] Field of Search ..... 164/418, 459

[56] References Cited

U.S. PATENT DOCUMENTS

| | | | |
|---|---|---|---|
| 2,126,808 | 8/1938 | Phillips | 164/418 |
| 3,910,342 | 10/1975 | Johnson | 164/418 |

FOREIGN PATENT DOCUMENTS

| | | | |
|---|---|---|---|
| 1919710 | 11/1970 | Fed. Rep. of Germany | 164/418 |
| 52-52823 | 4/1977 | Japan | 164/418 |
| 54-1648 | 1/1979 | Japan | 164/418 |
| 61-195745 | 8/1986 | Japan | 164/418 |
| 664745 | 5/1979 | U.S.S.R. | 164/418 |

*Primary Examiner*—Richard K. Seidel

*Attorney, Agent, or Firm*—Wegner & Bretschneider

[57] ABSTRACT

Method to obtain thin slabs by continuous casting, whereby the ratio between the short side and the long side of the slabs is greater than 1:10, the thin slabs (13) being obtained by casting in an ingot mould (10), the slab (13) becoming detached during cooling from the ingot mould (10) independently and automatically owing to its geometric conformation being such that its long sides (12) diverge from each other. Also set forth, an ingot mould (10) for the continuous casting of thin slabs, in which the dimensional ratio between the short side (11) and the long side (12) of the mould is between 1:10 and 1:100, the mould (10) employing the above method, at least one of the long sides (12) having an outline that includes a substantially continuous enlargement of the section of the mould, starting from one of the short sides (11).

4 Claims, 1 Drawing Sheet

METHOD TO OBTAIN THIN SLABS AND CRYSTALLIZER WHICH EMPLOYS SUCH METHOD

This invention concerns a method to obtain thin slabs by continuous casting. The invention concerns also a crystallizer that employs such method.

To be more exact, the invention concerns a crystallizer suitable for the continuous casting of thin slabs, that is to say, suitable to cast slabs of which the ratio between their short side and long side is between 1:10 and 1:100.

Methods and crystallizers to produce slabs are known, as also are the problems linked thereto.

The dimensional ratio between the short side and the long side of crystallizers of a known type which can function properly does not exceed 1:10.

In crystallizers for thin slabs with which the invention is concerned, as a result of the dimensional ratio between the short side and the long side of the crystallizer varying between 1:10 and 1:100, the solidifying material in the crystallizer tends to slip on the wall of the crystallizer.

This slipping leads to the formation of cracks and clefts in the material of the slab. Moreover, the resulting material does not possess the desired homogeneity in its cross section. Furthermore, the extraction forces which have to be applied to the slab are such as to entail the risk of the peeling and breakage of the slab as it leaves the crystallizer.

Problems of a mechanical nature and also of a metallurgical type have therefore to be tackled, with the consequence that the thin slabs which can be produced with the present state of the art and which result therefrom comprise cracks, clefts, lack of homogeneity, etc.

A crystallizer has been designed (EP 149734) which has an enlarged tapered conformation of its upper part, but this enlarged tapered conformation performs substantially only the purpose of enabling a casting plunger to be introduced; otherwise this introduction would be impossible as a result of the art employed by the patent applicant in question.

So as to obviate such drawbacks and obtain a plurality of advantages which will be made clear in the following description, the present applicant has studied and tested a method and a continuous casting crystallizer which are suitable to cast thin slabs, that is to say, suitable to cast slabs having a dimensional ratio of between 1:10 and 1:100 of their short side to their long side.

The method according to the invention provides for the slab during cooling to become detached from the crystallizer independently and automatically.

According to the invention the crystallizer has, at least as regards one of its long sides, a conformation which becomes enlarged progressively from its short side towards the middle of that long side.

This progressive enlargement enables a reduction in friction to be achieved as soon as the solidification period begins. This reduction in friction during solidification is obtained by exploiting the dimensional shrinkage taking place in the material itself.

More generally, the idea of the solution of the invention provides for exploitation of the dimensional shrinkage occurring in the material during cooling so as to achieve an independent, automatic, progressive detachment of the cast solidifying thin slabs from the crystallizer.

According to a variant the crystallizer may have a conformation whereby at least one whole long side is inclined.

According to other variants the crystallizer will have a greater width at an intermediate position in one of the two halves of the long side of the mould.

All these variants are such as will conform to the philosophy itself of the invention, whereby when solidification begins and even a very small shrinkage takes place, the section of the solidifying and therefore dimensionally shrinking slab tends to become detached independently and automatically from the crystallizer owing to the reciprocal geometry of the crystallizer and slab, and this detachment is accentuated by the inclination of at least part of at least one long side of the crystallizer and slab.

The invention is therefore obtained with a method to obtain thin slabs by continuous casting, whereby the ratio between the short side and the long side of the slabs is less than 1:10, the thin slabs being obtained by casting in crystallizer, the method being characterized in that the slab becomes detached during cooling from the crystallizer independently and automatically owing to its geometric conformation being such that its long sides diverge from each other.

The invention is also embodied with a crystallizer for the continuous casting of thin slabs, in which the dimensional ratio between the short side and the long side of the crystallizer between 1:10 and 1:100, the crystallizer employing the method described above and being characterized in that at least one of the long sides has an outline that includes a substantially continuous enlargement of the section of the crystallizer starting from one of the short sides.

The attached figures, which are given as a non-restrictive example, show some preferred embodiments of the invention as follows.

Figures 1, 2, 3, 4, 5, 6, 7, 8, 9:
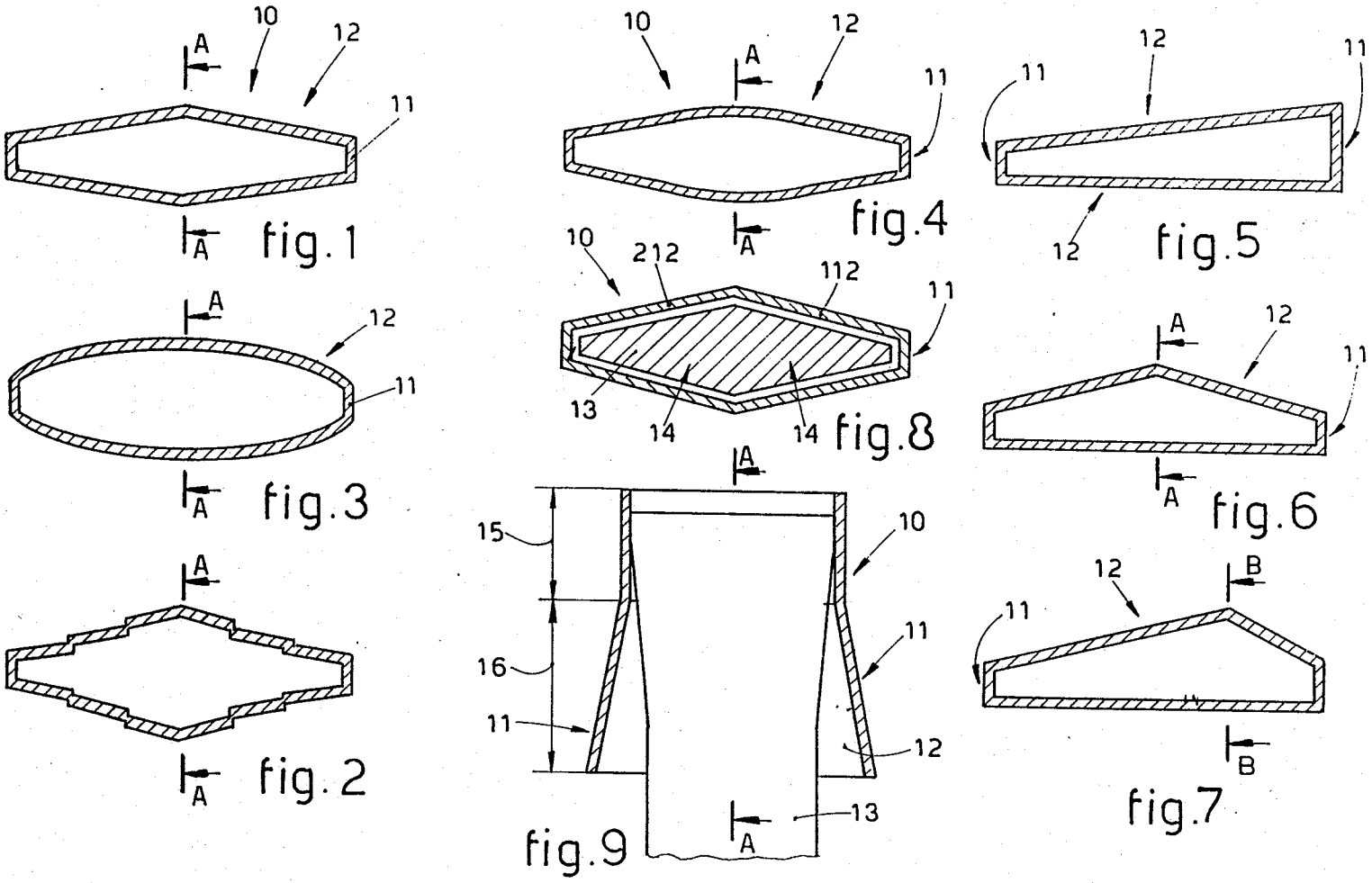
FIG. 1 shows a cross section of a crystallizer having a truncated rhombic shape, the acute angles being bevelled to form the short sides of a hexagonal-sahped crystallier.
FIG. 2 shows a cross section of a crystallicer formed with stepped segments having dimensions increasing progressively towards the centre of the crystallizer.
FIG. 3 shows a cross section of a crystallizer having convex long sides.
FIG. 4 shows a variant of FIG. 3.
FIG. 5 shows a quadrangular conformation with one long side inclined in relation to the other long side.
FIG. 6 shows a cross section of a crystallizer with one long side substantially straight, whereas the other long side is cusp-shaped.
FIG. 7 shows a variant of FIG. 6.
FIG. 8 shows the behaviour of the cooling mass during cooling within the ingot mould.
FIG. 9 shows an evolutive variant of the invention.

In the figures a crystallizer 10 has short sides 11 and long sides 12. The short sides 11 are drawn straight in the figures but may actually be bevelled and/or radiused to merge with the long sides 12.

In the working embodiments of FIGS. 1, 2, 3 and 6 at least one long side 12 has a substantially counterpart confirmation on each side of a plane A—A passing along the centerline of the long side 12 and positioned vertically to the crystallizer.

According to the variants of FIGS. 5 and 7 at least one long side 12 has a conformation that includes an enlargement offset from the center of that side. This enlargement may affect a short side (FIG. 5) or an intermediate position B—B on the long side 12, such intermediate position B—B being located in one half of that long side 12.

Besides being inclined in relation to each other, the long sides may be made with a curved or partly curved development that produces the same effect.

Other analogous and derived figures can be obtained very easily.

FIG. 8 makes evident the concept on which the invention is based. While cooling, the cast mass 13 tends to shrink continuously until it reaches a state of equilibrium.

By shrinking or contracting, the cast mass 13 tends to produce a separation according to the arrows 14 from the sides 212, 112 and 11, being assisted in this result by the geometric conformation of the sides themselves.

The modest inclination of the long sides 12 enhances the action of separation. According to the invention the inclination will be between 1/50 and 1/5 (horizontal change/vertical change), but advantageously from about 1/10 to 1/20.

The inclination of the long sides 12 in cooperation with the geometric configuration of the cooling mass 13 accentuates the separation effect.

Even when it is very slight, this separation is enough to reduce the friction between the outer surface of the slab 13 and the inner surface of the crystallizer 10.

This reduction in friction provides a plurality of advantages. It reduces the force needed for extraction of the slab; it avoids the superficial dragging effect due to the different speeds of the outer skin and the inside of the cooling slab 13; it prevents any lack of homogeneity which is not due to the material itself; it obviates the formation of cracks and clefts.

According to an evolutive variant the crystallizer 10 may have a uniform vertical conformation along an initial tract 15, whereas its remaining vertical tract 16 may have a diverging bell-shaped conformation, thus producing a separation of the slab from the side wall of the crystallizer and also a natural separation in the lower part of the crystallizer.

I claim:

1. A method for obtaining thin slabs by continuous casting in a crystallizer, wherein the ratio of the short sides to the long sides of the crystallizer is less than 1:10, said method comprising:

introducing casting material into said crystallizer to form the slab;

cooling said slab, said slab automatically and independently becomimg detached from the sides of said crystallizer during cooling due to the geometric configuration of said crystallizer, wherein the long sides of the crystallizer diverge from each other intermediate their ends.

2. A crystallizer for the continuous casting of thin slabs, said crystallizer comprising:

a pair of opposing short sides; and a pair of opposing long sides, wherein the ratio of each of said short sides to each of said long sides is between 1:10 and 1:100, and wherein at least one of said long sides is formed so that the width of said crystallizer gradually increases from one of said short sides toward said other short side, and wherein the cross-sectional area of said crystallizer remains constant along an upper lengthwise portion and then gradually increases along a lower lengthwise portion.

3. A crystallizer as in claim 2, wherein said long sides flare outwardly along said lower lengthwise portion with an inclination of between 1/50 and 1/5.

4. A crystallizer as in claim 3, wherein said inclination is between 1/10 and 1/20.

* * * * *